US006322008B1

(12) United States Patent
Aker et al.

(10) Patent No.: US 6,322,008 B1
(45) Date of Patent: Nov. 27, 2001

(54) LIQUID IMPINGEMENT NOZZLE WITH PAIRED OPENINGS

(75) Inventors: Mark Aker, Plymouth, IN (US); Thomas A. Hedger; James E. Hedger, both of Largo, FL (US)

(73) Assignee: Graves Spray Supply, INC, Clearwater, FL (US)

( * ) Notice: Subject to any disclaimer, the term of this patent is extended or adjusted under 35 U.S.C. 154(b) by 0 days.

(21) Appl. No.: 09/402,526

(22) PCT Filed: Apr. 12, 1999

(86) PCT No.: PCT/US99/07959

§ 371 Date: Oct. 5, 1999

§ 102(e) Date: Oct. 5, 1999

(87) PCT Pub. No.: WO00/41814

PCT Pub. Date: Jul. 20, 2000

Related U.S. Application Data

(63) Continuation-in-part of application No. 09/277,678, filed on Mar. 26, 1999, now abandoned, which is a continuation-in-part of application No. 09/228,168, filed on Jan. 11, 1999, now abandoned.

(51) Int. Cl.[7] ..... B05B 1/04
(52) U.S. Cl. ..... 239/543
(58) Field of Search ..... 239/543, 544, 239/545, 418, 433

(56) References Cited

U.S. PATENT DOCUMENTS

| | | |
|---|---|---|
| Re. 30,486 | 1/1981 | Beck . |
| 2,249,205 | 7/1941 | Hansen . |
| 2,335,116 | 11/1943 | Hansen . |
| 2,551,538 | 5/1951 | Hensel . |
| 2,941,696 | 6/1960 | Homm . |
| 3,033,472 | 5/1962 | Shelton et al. . |
| 3,045,925 | 7/1962 | Gianqualano . |
| 3,542,296 | 11/1970 | Bradley . |
| 3,986,672 | 10/1976 | Smith et al. . |
| 4,824,017 | 4/1989 | Mansfield . |
| 4,854,504 | 8/1989 | Hedger, Jr. et al. . |
| 4,925,104 | 5/1990 | Smith . |
| 4,948,048 | 8/1990 | Smith . |
| 5,067,515 | 11/1991 | Smith . |
| 5,085,370 | 2/1992 | Smith . |
| 5,088,649 | 2/1992 | Hanson et al. . |
| 5,516,045 | 5/1996 | Baudin . |
| 5,540,200 | 7/1996 | Naitoh et al. . |
| 5,704,548 | 1/1998 | Hedger et al. . |

*Primary Examiner*—Lesley D. Morris
(74) *Attorney, Agent, or Firm*—Larson & Larson, P.A.; James E. Larson

(57) ABSTRACT

The nozzle (10) has at least one pair of openings (18, 20) located on its front face (28) along a common axis (32). Each opening (18, 20) is spaced apart (26) from and angled towards its pair mate. A non-atomized solid liquid stream (14, 16) is directed through each circular opening (18, 20) by a pressurized source. The two streams (14, 16) from each pair of openings (18, 20) meet at a spaced apart point in front of the nozzle face (28) to create a flat triangular pattern of liquid (24).

31 Claims, 5 Drawing Sheets

LIQUID IMPINGEMENT NOZZLE WITH PAIRED OPENINGS

PRIOR APPLICATIONS

This application is a §371 U.S. National Phase application which bases priority on International Application No. PCT/US99/07959, filed Apr. 12, 1999, which is a continuation-in-part of U.S. Ser. No. 09/228,168, filed Jan. 11, 1999 and U.S. Ser. No. 09/277,678, filed Mar. 26, 1999.

TECHNICAL FIELD

This invention relates to liquid spray nozzles. More particularly, it refers to a spray nozzle having openings angled towards each other to form a triangular spray pattern from two impacting non-atomized liquid streams.

BACKGROUND ART

Spray nozzles for generating streams of liquid are well known as seen from U.S. Pat. No. 4,854,504 which describes a resin being emitted from a nozzle having an oval opening in the center and streams of catalyst impinging on the resin stream from angles on each side of the oval opening. In addition, air control nozzles are located on either side of the catalyst openings and these also impinge on the resin stream after the catalyst has been mixed with the resin stream. Other patents showing an external mix spraying system are U.S. Pat. Nos. 4,824,017, 5,085,370 and 5,067,515. The latter two show multi-fluid spray guns in which a resin catalyst is mixed in externally. Other spray guns are shown in U.S. Pat. Nos. 4,948,048 and 4,925,104. A more recent U.S. Pat. No. 5,704,548, shows another type of spray nozzle.

In the commercial literature it is well known to design spray nozzles with elliptical openings or with rows of parallel openings to obtain different types of spray patterns. A common spray pattern achieved with a single circular opening is cone shaped. Although these nozzles are useful for their particular purposes, no one to date has developed a nozzle that can produce a triangular type pattern from two solid streams of liquid absent any atomization or obstruction to the stream pattern after leaving the nozzle head. An improved nozzle is needed for providing a broad triangular pattern of liquid for use with fire hoses, building sprinklers, agricultural headers, car wash nozzles and for spraying resins over molds to create various devices such as boat hulls, bath tubs, etc. This latter use needs to be carried out with minimum contamination to the environment.

The open contact molding process using polyester resins employs nozzles having at least two series of parallel openings and is known as a FLOCOAT nozzle. This nozzle creates several streams in a fan-like spray pattern and reduces noxious emissions to the atmosphere. Unfortunately, the size limitation of the nozzle openings of 0.010 to 0.030 inches causes constant plugging in some applications. Therefore, FLOCOAT nozzles cannot be used in the tub/shower and other industries where it is necessary to add fillers such as calcium sulfate, calcium carbonate and aluminum trihydrate to the resin for fire retardency as well as economics. These fillers are fairly large in size and tend to agglomerate resulting in constant tip plugging when a FLOCOAT nozzle is used. The gaps created in the FLOCOAT pattern also eliminate it from being used to apply polyester gelcoat. This is typically the first coating applied to a mold when producing a fiberglass part. Its primary purpose is to provide shielding as well as a cosmetic finish and it is typically applied in a thin film of between 0.010 to 0.040 inches. The FLOCOAT nozzle does not provide uniform coverage in this thickness range and therefore is unacceptable for this application. It is for these reasons that these two very large segments of the fiberglass industry; i.e., filled resins and gelcoats, cannot utilize FLOCOAT technology to reduce emissions.

The tub/shower and related industries consume the most polyester resins and has the greatest potential of emitting styrene from the spraying equipment used. Styrene is emitted during the application stage when a catalyzed gelcoat or resin is applied to the surface of an open mold. The Environmental Protection Agency (EPA) of the U.S. Government is actively seeking ways to limit these styrene emissions. Additional standards for the reinforced plastics and composite source category and boat building source category are scheduled to be promulgated by the EPA on Nov. 15, 2000.

Based on recent EPA reports, in their gelcoat experiments, volatile organic compounds could be reduced if an improved fan pattern for spray nozzles could be developed. The present invention responds to that need.

DISCLOSURE OF INVENTION

The nozzle of this invention creates a novel flat triangular spray pattern that significantly reduces emissions of volatile organic compounds. The nozzles of this invention can be used in polyester gelcoat applications to reduce emissions of volatile organic compounds from the conventional airless air assist nozzles of 70–80 ppm to 20–30 ppm using the nozzle of this invention.

The front face of the nozzle has at least one pair of openings spaced apart from each other and angled towards each other from 1° to 89°. The preferred embodiment employs circular openings. A non-atomized pressurized solid liquid stream passes through each opening and meets at a designated distance in front of the nozzle opening depending on the angle of incidence selected for each opening of the pair of openings. No object is interposed between the front face of the nozzle and the point of intersection of the two streams of liquid. At the point of intersection of the two streams an apex of a triangular stream pattern is formed.

The liquid pattern produced by the nozzle of this invention provides uses in a myriad of industries and was not previously realized as being possible from a pair of angled openings in a nozzle face. In addition, it produces a spray pattern in the resin industry that substantially reduces emissions to the environment of styrene and other volatile organic compounds.

BRIEF DESCRIPTION OF DRAWINGS

The invention can be best understood by those having ordinary skill in the art by reference to the following detailed description when considered in conjunction with the accompanying drawings in which.

BEST MODE FOR CARRYING OUT THE INVENTION

Figure 1:
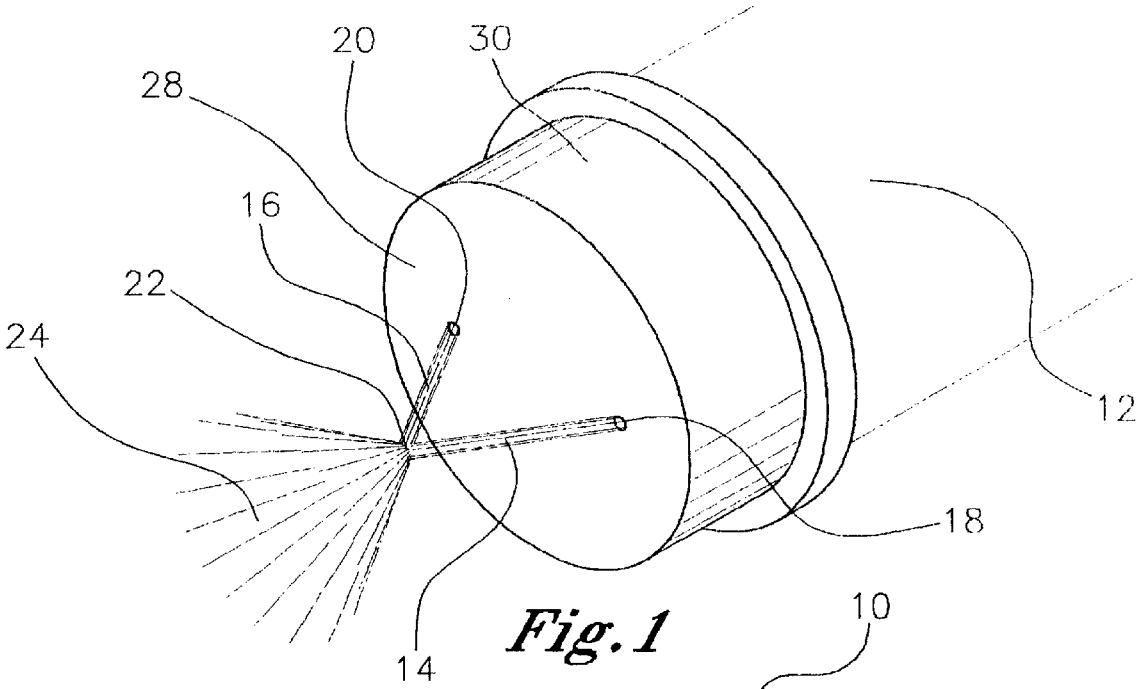
FIG. 1 is a perspective view of the spray pattern generated by the nozzle of this invention.
Figure 2:
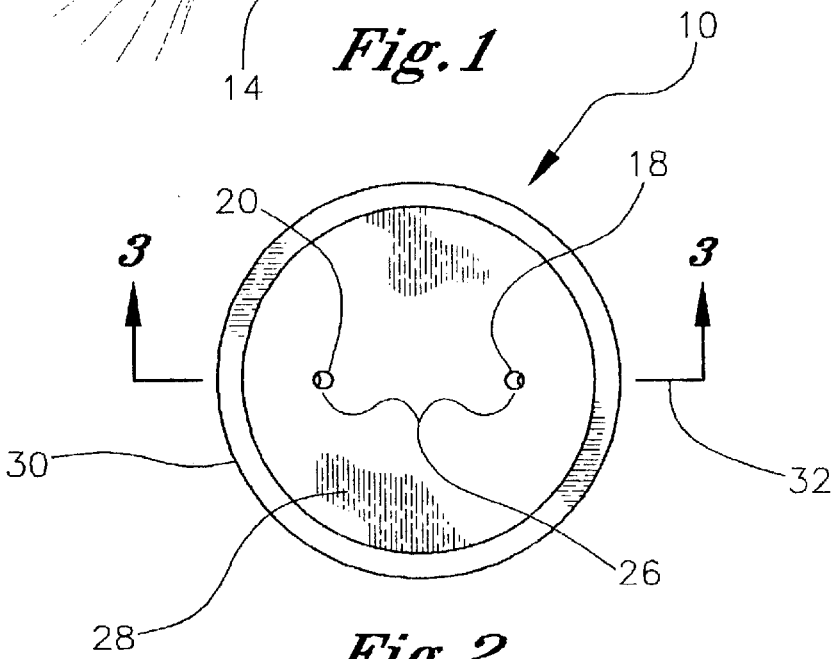
FIG. 2 is a front elevational view of the inventive spray nozzle with one pair of circular openings.
Figure 3:
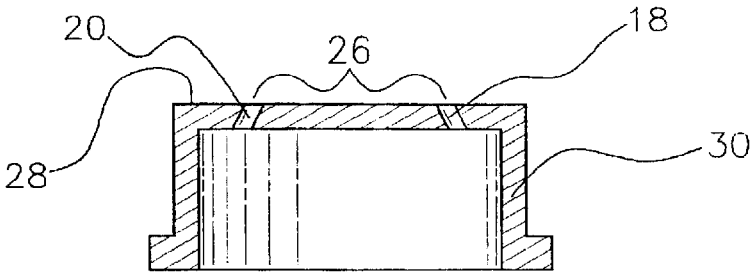
FIG. 3 is a sectional view along lines 3—3 of FIG. 2.
Figure 8:
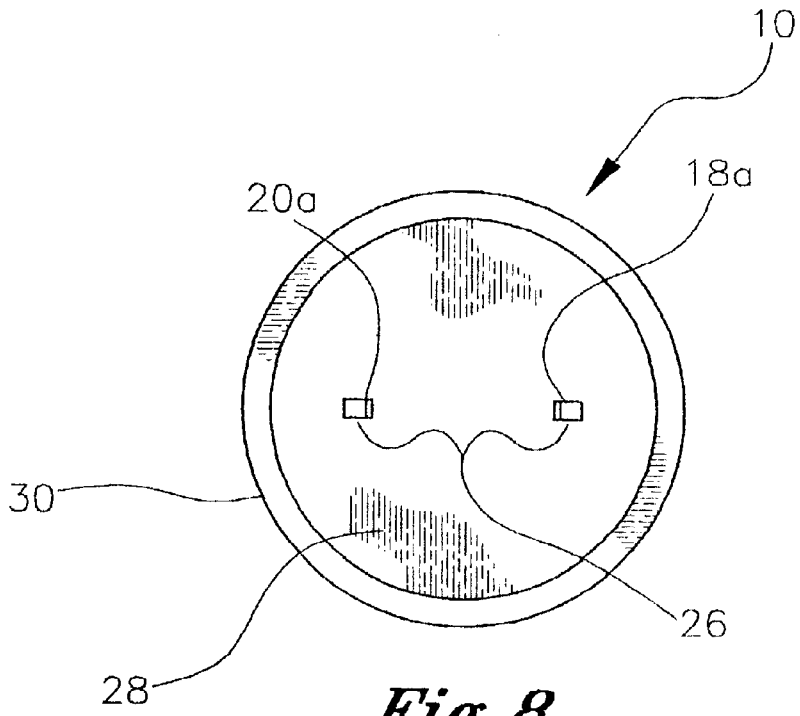
FIG. 8 is a perspective view of an impingement tip with rectangular openings.
Figure 9:
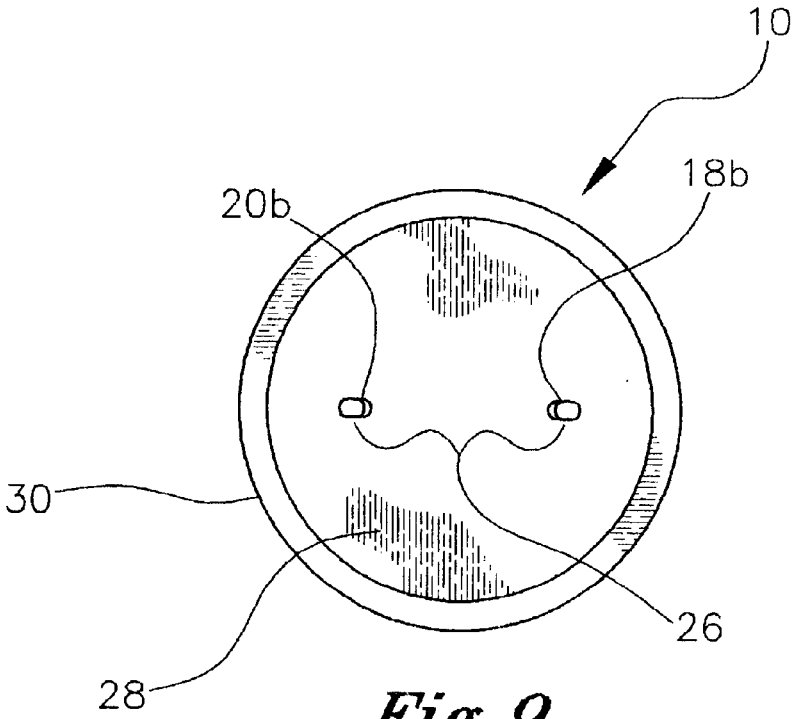
FIG. 9 is a perspective view of an impingement tip with elliptical slot openings.
Figure 10:
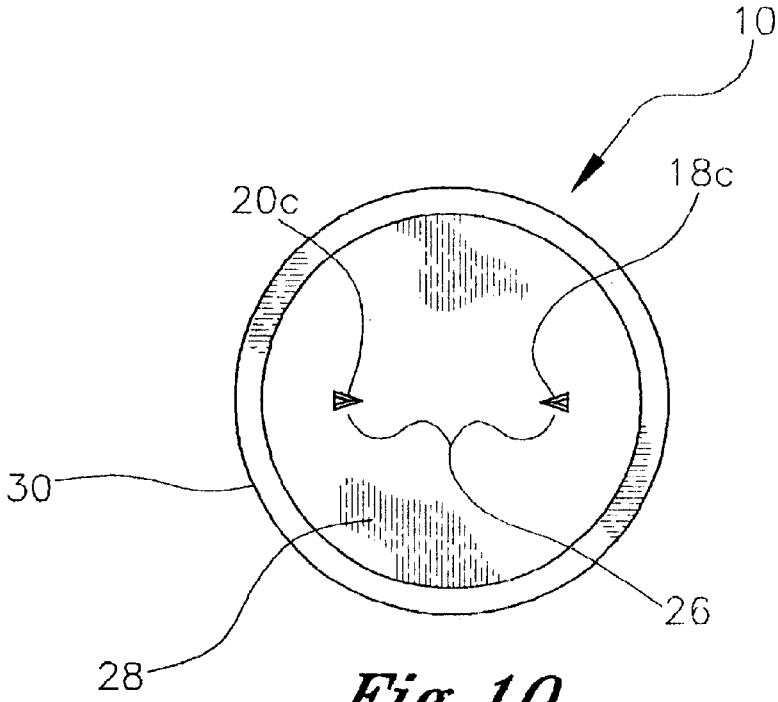
FIG. 10 is a perspective view of an impingement tip with triangular openings.
Figure 11:
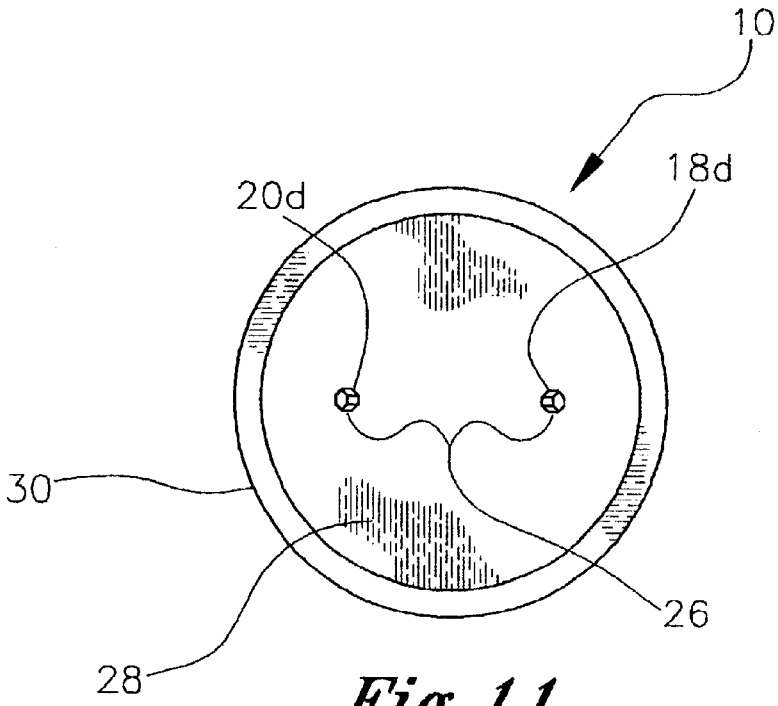
FIG. 11 is a perspective view of an impingement tip with octagonal openings.

Throughout the following detailed description, the same reference numerals refer to the same elements in all figures. The nozzle 10 of this invention shown in FIGS. 1 and 2 is affixed to a spray gun 12 which has a pressurized source (not shown) such as a pump that directs liquid streams 14 and 16 from nozzle openings 18 and 20 respectively. In the preferred embodiment, openings 18 and 20 are circular as shown in FIGS. 1 through 3. The liquid streams can be the same or different liquids. The liquid streams 14 and 16 meet at apex 22 to form a flat uniform triangular 24 spray pattern. The distance 26 between openings 18 and 20 and the angle of openings 18 and 20 towards each other determines the distance from the face 28 of nozzle 10 of the apex 22. The smaller the angle between 18 and 20 as shown in FIG. 3 the closer the meeting of the two streams 14 and 16 to the front face 28 of the nozzle. The nozzle openings 18 and 20 can be circular as shown in FIG. 2, rectangular 18*a* and 20*a* (see FIG. 8), elliptical 18*b* and 20*b* (see FIG. 9), triangular 18*c* and 20*c* (see FIG. 10 ), octagonal 18*d* and 20*d* (see FIG. 11), or other polygonal shape, and be located on the same axis 32 as shown in FIG. 2. Additional pairs of nozzles can be inserted on the same axis 32 of face 28 to generate triangular spray patterns. In each case the pairs of openings in the nozzle must be angled towards each other in order to obtain the triangular spray pattern 24.

Figure 4:
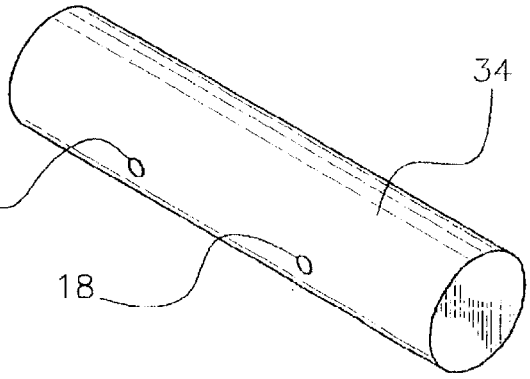
FIG. 4 is a perspective view of a cylindrical impingement tip for a spray nozzle of this invention.
Figure 5:
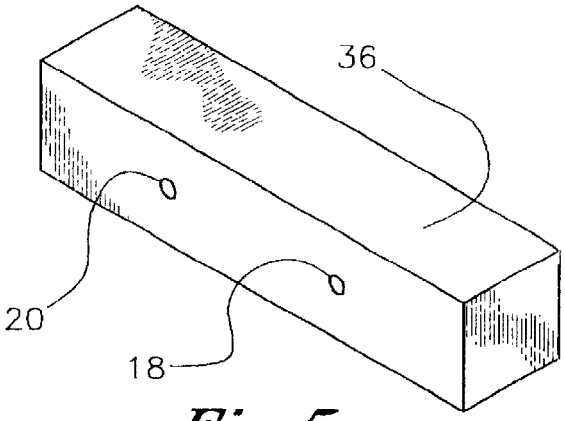
FIG. 5 is a perspective view of a rectangular impingement tip for a spray nozzle of this invention.
Figure 6:
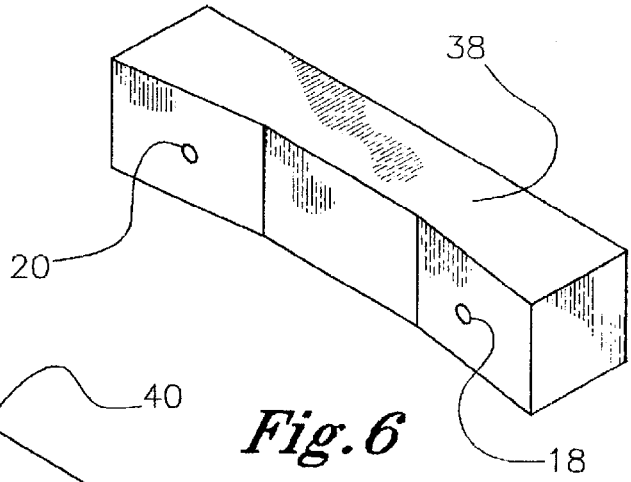
FIG. 6 is a perspective view of a V-groove impingement tip for a spray nozzle of this invention.
Figure 7:
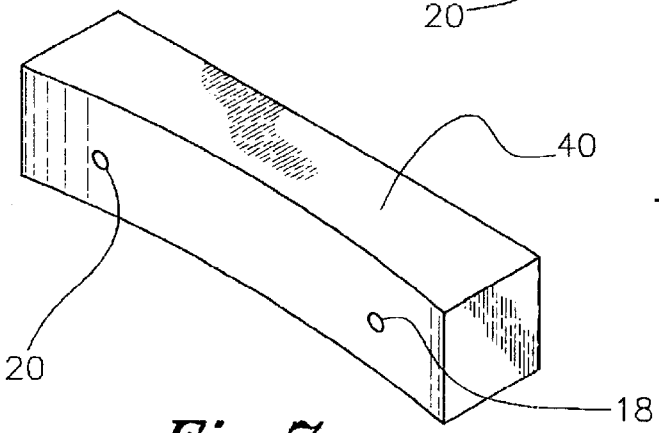
FIG. 7 is a perspective view of a concave impingement tip for a spray nozzle of this invention.

Alternative to the openings in the round impingement tip 30 shown in FIG. 2 one can have the same openings in a cylindrical impingement tip 34 as seen in FIG. 4. The nozzle openings 18 and 20 are the same as the nozzle openings 18 and 20 in FIG. 2 and are located along the same axis. In like manner, the impingement tip can be rectangular 36 as shown in FIG. 5. Still further, an alternative grooved impingement tip 38 is shown in FIG. 6 and a concave impingement tip 40 is shown in FIG. 7. In each case the openings 18 and 20 are angled towards each other so that the streams 14 and 16 meet at apex 22 as shown in FIG. 1 and form the flat triangular spray pattern 24.

The angle of openings 18 and 20 towards each other can be anywhere from 1° to 89°. Of course the smaller the degree of angle with respect to face 28 the closer the two streams will be spaced at apex 22 from the face 28 of the impingement tip. It is preferred for the use in the resin industry to have the angle of openings 18 and 20 from face 28 to be 2° to 55°. Generally, in non-circular configurations, the area of the openings can be 0.00002 to 3.5 square inches. In the preferred embodiment, the diameter of the circular openings 18 and 20 should be from 0.005 to 0.175 inches as used in the resin industry. The spacing between the two openings 18 and 20, regardless of the shape of openings 18 and 20, for general use, such as to apply paint and other coatings, should be 0.010 to 2.0 inches. These preferred parameters are most useful for sealer/coating nozzles. In agricultural and water nozzles the angle of openings 18 and 20 is preferred to be between 5° and 75° with a circular opening diameter of 0.010 to 0.20 inches and the distance between the openings 18 and 20 being 0.10 to 16 inches. The pump pressure to drive the liquid through openings 18 and 20 can be anywhere from 10 to 2,000 psi depending upon the type of use employed. It is preferred for resin uses that the pressure be only 50 to 750 psi.

The bigger headers that can be as much as one foot wide would be used for putting out fires, for building sprinklers, agricultural headers or car wash nozzles. Additional pairs of openings for producing triangular patterns can be used on the front face of the header but must be on the same axis 32 and be angled in such a fashion as to not interfere with the spray pattern generated by another pair of nozzle openings on that axis.

The following two EXAMPLES describe data from a summary of four test runs employing a preferred nozzle utilizing circular openings 18 and 20 of this invention:

EXAMPLE I

| EXAMPLE I | |
|---|---|
| Resin | Standard ortho unsaturated polyester resin having a styrene content of 40–42%. |
| Pressure | 180 psi |
| Catalyst level | 2 percent |
| Resin Output | 7.5 lbs/minute |
| Glass Fiber Delivery | 2.5 lbs/minute |
| Target Distance | 24 inches |
| Sample Time | 30 seconds from beginning of spray |
| Sample Source | Eighteen inches above exhaust fan inside exhaust stack. |
| Styrene Testing Device | Sensidyne Model 800 Gas Sampling Pump |
| Impingement Nozzle | Two circular openings on same axis angled 25° from the nozzle face towards each other, each opening having a 0.080 inch diameter and separated by 0.5 inches. |
| Results | Styrene emission 14 ppm. |
| EXAMPLE II | |
| Gelcoat | Standard ISO NPG Gelcoat |
| Styrene content | 40–42% |
| Pressure | 350 psi |
| Catalyst Level | 2 percent |
| Target Distance | 24 inches |
| Sample Time | 30 seconds from beginning of spray |
| Sample Source | Eighteen inches above exhaust fan inside of exhaust stack |
| Styrene Testing Device | Sensidyne Model 800 Gas Sampling Pump |
| Impingement Nozzle | Two circular openings on same axis angled 25° from the nozzle face towards each other, each opening having a 0.025 inch diameter and separated by 0.5 inches |
| Results | Styrene emission 34 ppm. |

Conventional airless air assist nozzles used in similar tests generated 70–80 ppm styrene emissions, whereas the nozzles used in this invention generate substantially less styrene emissions.

No bar or other obstruction is present in front of the nozzle face 28 to generate the triangular spray pattern from the nozzle of the present invention. Various other nozzle impingement tips of different geometry including spray tip openings mounted on any support structure can be substituted for the impingement tips described in this invention to generate the desired triangular pattern of this invention provided that the orifice openings are angled towards each other, conform to the shape described herein and are on a common axis.

Figure 12:
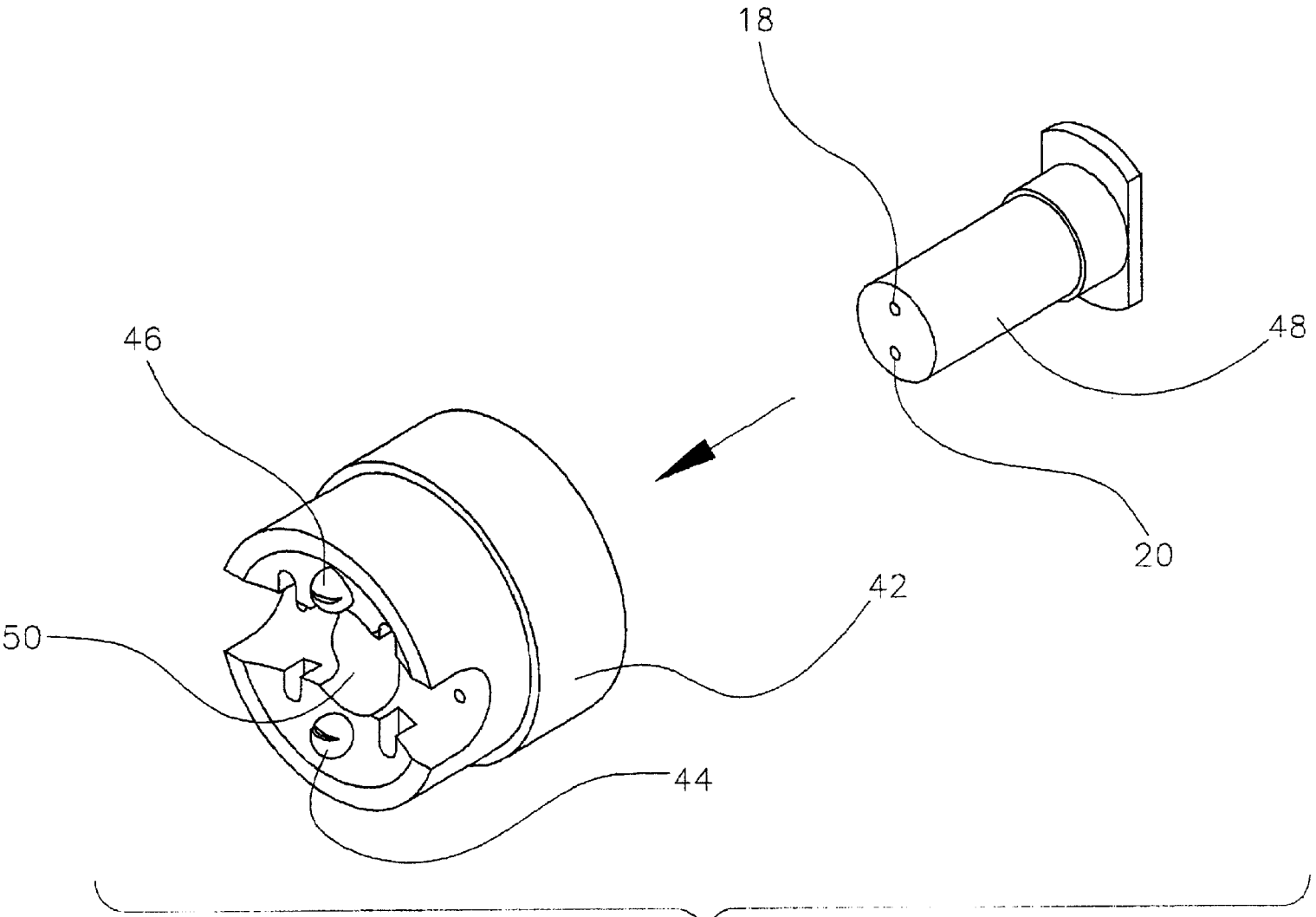
FIG. 12 is an exploded view of an impingement tip used to mount within a catalyst tip.

Additional nozzle openings for use with air assist or to add catalyst could be added to the nozzle face 28 as seen in FIG. 12 where a catalyst tip 42 having catalyst source openings 44 and 46 are mounted on each side of the impingement tip 48. The impingement tip 48 having openings 18 and 20 is mounted in the center 50 of catalyst tip 42 so that catalyst can be sprayed on the triangular resin stream.

Other impingement tip openings that can form a triangular resin stream can be substituted for the nozzle openings described herein to produce the desirable reduction in volatile organic compounds produced during spraying processes.

What is claimed is:

1. A nozzle for mounting on a source of a liquid for forming a spray pattern, the nozzle comprising:

(a) at least one pair of openings in a face adapted for generating an uninterrupted non-atomized solid liquid stream of the same liquid from each pair of openings directed towards each other;

(b) each opening from each pair of openings being spaced apart from each other and angled along a common axis towards each other at an angle from 1° to 89°;

(c) the nozzle adapted to receive the non-atomized solid liquid stream directed through each opening by a pressurized source; and (d) the openings configured so the same non-atomized solid liquid stream from each opening from each pair of openings meet at a distance spaced apart from the common axis without interference from any solid object interposed between the common axis and the meeting of the same non-atomized solid liquid streams from the openings, the meeting of the same non-atomized solid liquid streams creating a triangular type liquid spray pattern.

2. The nozzle according to claim 1, wherein the at least one pair of openings is circular in shape.

3. The nozzle according to claim 2, wherein each opening of the at least one pair of circular openings has a diameter of 0.005 to 2.0 inches.

4. The nozzle according to claim 1, wherein each opening of the at least one pair of openings has an area of 0.00002 to 3.5 square inches.

5. The nozzle according to claim 1, wherein the distance between the at least one pair of openings is 0.005 to 2.00 inches.

6. The nozzle according to claim 1, wherein the opening in each pair of openings are angled towards each other from 2° to 55°.

7. The nozzle according to claim 1 wherein the pressurized source is a pump or pressure vessel generating pressure on the solid liquid stream of 10 to 20000 psi.

8. The nozzle according to claim 7 wherein the pressure is 50 to 750 psi.

9. A nozzle for mounting on a source of a liquid for forming a spray pattern, the nozzle comprising:

(a) a means for mounting at least one pair of openings on a front face of the nozzle along a common axis;

(b) the openings within each pair being spaced apart and angled from the front face towards each other from 1° to 89°;

(c) the nozzle adapted to receive a non-atomized solid liquid stream of the same liquid directed through each opening by a pressurized source; and (d) the openings configured so the same non-atomized solid liquid stream from each opening intersect at a distance spaced apart from the front face without interference from any solid object interposed between the front face and the intersection of the same non-atomized solid liquid streams from the openings, the intersection of the same non-atomized solid liquid streams creating a triangular type liquid spray pattern.

10. The nozzle according to claim 9, wherein the means for mounting at least one pair of openings on a front face of the nozzle is an impingement tip with a pair of drilled holes through the tip front face.

11. The nozzle according to claim 9, wherein the at least one pair of openings are circular in shape.

12. The nozzle according to claim 11, wherein each opening of the at least one pair of circular openings has a diameter of 0.005 to 2.0 inches.

13. The nozzle according to claim 9, wherein each opening of the at least one pair of openings has an area of 0.00002 to 3.5 square inches.

14. The nozzle according to claim 9, wherein the at least one pair of openings is rectangular in shape.

15. The nozzle according to claim 9, wherein the at least one pair of openings is elliptical in shape.

16. The nozzle according to claim 9, wherein the at least one pair of openings is polygonal in shape.

17. The nozzle according to claim 9, wherein the at least one pair of openings is angled towards each other from 2° to 55°.

18. The nozzle according to claim 9, wherein the at least one pair of openings is spaced apart from 0.005 to 2.0 inches.

19. The nozzle according to claim 9, wherein the pressurized source is a pump or pressure vessel generating pressure on the solid liquid stream of 10 to 20000 psi.

20. The nozzle according to claim 9, wherein the pressure is 50 to 750 psi.

21. The nozzle according to claim 9, wherein an additional liquid stream emanates from another opening in the nozzle face and mixes with the solid liquid streams.

22. A nozzle for mounting on a source of a liquid for forming a spray pattern, the nozzle comprising:

(a) a front face having at least one pair of openings along a common axis;

(b) the openings within each pair being spaced apart from 0.005 to 2.0 inches and angled from the front face towards each other from 2° to 55°;

(c) the nozzle adapted to receive a non-atomized solid liquid stream of the same liquid directed through each opening by a pressurized source generating pressure on the solid liquid stream of 10 to 2000 psi; and (d) the openings configured so the same non-atomized solid liquid stream from each pair of openings intersect at a distance spaced apart from the front face without interference from any solid object interposed between the front face and the intersecting of the same non-atomized solid liquid streams from the pair of openings, the intersecting of the same non-atomized solid liquid streams from each pair of openings creating a triangular type liquid spray pattern.

23. The nozzle according to claim 22, wherein the at least one pair of openings is circular in shape.

24. The nozzle according to claim 23, wherein each opening of the at least one pair of circular openings has a diameter in the range of 0.005 to 2.0 inches.

25. The nozzle according to claim 22, wherein the shape of the at least one pair of openings is chosen from the group including rectangular, elliptical and polygonal.

26. The nozzle according to claim 25, wherein each opening of the at least one pair of openings has an area of 0.00002 to 3.5 square inches.

27. A nozzle for mounting on a source of a liquid for forming a spray pattern, the nozzle comprising:

(a) a device for mounting at least one pair of circular openings on a fixed support along a common axis;

(b) the circular openings within each pair being spaced apart and angled from the common axis towards each other from 1° to 89°;

(c) the nozzle adapted to receive a non-atomized solid liquid stream of the same liquid directed through each circular opening by a pressurized source, and (d) the circular openings configured so the same non-atomized solid liquid stream from each circular opening meet at a distance spaced apart from the common axis without interference from any object interposed between the common axis and the meeting of the same non-atomized solid liquid streams from the circular openings, the meeting of the same non-atomized solid liquid streams creating a triangular type liquid spray pattern.

28. The nozzle according to claim 27, wherein each pair of circular openings are angled towards each other from 2° to 55°.

29. The nozzle according to claim 27, wherein each opening of the at least one pair of circular openings has a diameter from 0.005 to 2.0 inches.

30. The nozzle according to claim 27, wherein the pressurized source is a pump or pressure vessel generating pressure on the solid liquid stream of 10 to 2000 psi.

31. The nozzle according to claim 30, wherein the pressure is 50 to 750 psi.

* * * * *